US008202115B2

(12) United States Patent
Suzuki et al.

(10) Patent No.: US 8,202,115 B2
(45) Date of Patent: Jun. 19, 2012

(54) WIRE HARNESS AND METHOD OF MANUFACTURING THE SAME

(75) Inventors: Sachio Suzuki, Hitachi (JP); Hideaki Takehara, Hitachi (JP); Kunihiro Fukuda, Tsukuba (JP); Yuta Kataoka, Hitachi (JP); Shinya Hayashi, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 20 days.

(21) Appl. No.: 12/923,640

(22) Filed: Sep. 30, 2010

(65) Prior Publication Data

US 2011/0159729 A1 Jun. 30, 2011

(30) Foreign Application Priority Data

Dec. 24, 2009 (JP) ..... 2009-293346

(51) Int. Cl.
*H01R 13/58* (2006.01)

(52) U.S. Cl. ..... 439/604; 439/936

(58) Field of Classification Search ..... 439/587, 439/604, 460, 936

See application file for complete search history.

(56) References Cited

U.S. PATENT DOCUMENTS

| | | | | |
|---|---|---|---|---|
| 6,250,972 | B1 | 6/2001 | Shinchi et al. | |
| 7,390,217 | B2 * | 6/2008 | Scott | 439/604 |
| 2001/0003688 | A1 * | 6/2001 | Kondo | 439/604 |

FOREIGN PATENT DOCUMENTS

| | | |
|---|---|---|
| JP | 11-066807 | 3/1999 |
| JP | 2000-048901 | 2/2000 |

* cited by examiner

*Primary Examiner* — Khiem Nguyen
(74) *Attorney, Agent, or Firm* — McGinn IP Law Group, PLLC

(57) ABSTRACT

A wire harness includes a plurality of cables arranged in parallel, and a connector including a housing to which end portions of the plurality of cables are connected. An air-tight block includes two closing parts, an insertion part, a press receiving part, and an air escape opening part that opens from a cable insertion hole between the closing parts toward an outside of the air-tight block. Air-tightness between the air-tight block and the cables is maintained by a first step that a melting member is vibrated and pressed to the press receiving part to have a melt resin, which is poured into a gap between the closing parts, and a periphery of the cables is covered with the melt resin, a second step that the air escape opening part is closed, and a third step that the cables are pressed by the melt resin poured into the gap.

10 Claims, 10 Drawing Sheets

2a-2c CABLE
35 AIR-TIGHT BLOCK
37 MELTING MEMBER
40 FIRST PRESS RECEIVING PART
41 AIR ESCAPE OPENING PART 2a-2c CABLE
35 AIR-TIGHT BLOCK
37 MELTING MEMBER
40 FIRST PRESS RECEIVING PART
41 AIR ESCAPE OPENING PART 2a-2c CABLE
35 AIR-TIGHT BLOCK
36 GAP
37 MELTING MEMBER
38 SANDWICHING PART 2a-2c CABLE
35 AIR-TIGHT BLOCK
37 MELTING MEMBER
40 FIRST PRESS RECEIVING PART
41 AIR ESCAPE OPENING PART 2a-2c CABLE
35 AIR-TIGHT BLOCK
37 MELTING MEMBER
41 AIR ESCAPE OPENING PART
43 MELT RESIN 2a-2c CABLE
35 AIR-TIGHT BLOCK
37 MELTING MEMBER
43 MELT RESIN
44 CLOSING MEMBER 2a-2c CABLE
35 AIR-TIGHT BLOCK
37 MELTING MEMBER
81 SECOND INSERTION PART
82 SECOND PRESS RECEIVING PART

WIRE HARNESS AND METHOD OF MANUFACTURING THE SAME

The present application is based on Japanese patent application No. 2009-293346 filed on Dec. 24, 2009, the entire contents of which are incorporated herein by reference.

BACKGROUND OF THE INVENTION

1. Field of the Invention

This invention relates to a wire harness that is capable of sufficiently maintaining air-tightness between a housing of a connector and a cable and a method of manufacturing the wire harness.

2. Description of the Related Art

Generally, in a wire harness used for vehicles etc., a water proof structure is installed between the housing of the connector and the cable in order to prevent water or the like from entering into the inside of the connector so as to cause a problem.

A conventional wire harness 111 shown in FIGS. 17A and 17B uses a wire seal 114 as the air-tightness maintaining structure.

The wire harness 111 is configured to maintain the air-tightness between the outer housing 113 of the connector 116 and the cable 112 by that a wire seal 114 formed of rubber for waterproofing is inserted between the outer housing 113 of the connector 116 and the cable 112, the wire seal 114 is crushed between the outer housing 113 and the cable 112 so that it is brought into close contact with both of the outer housing 113 and the cable 112.

In the outer housing 113, a cable insertion hole 117 into which an end portion of the cable 112 is inserted is formed, and the wire seal 114 is housed in a wire seal housing concave portion 118 formed in an insertion side of the cable insertion hole 117 of the outer housing 113. An opening part of the wire seal housing concave portion 118 is blocked with a tail plate 115 in order to prevent the wire seal 114 from dropping out.

However, in case of using the wire seal 114 for the air-tightness maintaining structure between the outer housing 113 and the cable 112, it is necessary to install the wire seal 114 corresponding to each of the cables 112 and house each of the wire seals 114 in the wire seal housing concave portion 118, so that in designing, a distance between the cables is broadened and it becomes difficult to shorten a pitch of the cable 112. In particular, the wire harness for vehicles is required to be downsized, so that there is a need for an air-tightness maintaining structure that is capable of further shortening the pitch of the cable 112.

Then, as shown in FIG. 18A, a wire harness 121 is proposed, that is configured to maintain the air-tightness between the outer housing 123 and the cable 122 by that the cable 122 is sandwiched between the outer housing 123 formed of a resin and a welding member 124 formed of a resin, the welding member 124 is welded to the outer housing 123 due to ultrasonic welding by using a horn 125 (for example, refer to JP-A-2000-48901).

As show in FIG. 18 B, the wire harness 121 has a structure obtained by a method that grooves 123*a* are formed in the outer housing 123 and grooves 124*a* are formed in the welding member 124 respectively, cables 122 are disposed in the grooves 123*a* of the outer housing 123 and simultaneously the welding member 124 is stacked from above so as to locate the grooves 124*a* within positions of the cables 122, and in this condition, the horn 125 is brought into contact with an upper surface of the welding member 124 and is pressed from above down below while the welding member 124 is vibrated, and the welding member 124 is welded to the outer housing 123 due to the ultrasonic welding.

This technique is disclosed in, for example, JP-A-2000-48901 and JP-A-11-66807.

SUMMARY OF THE INVENTION

However, the above-mentioned wire harness 121 has a problem described below.

In the technique about the ultrasonic welding a disclosed in JP-A-2000-48901, a sheath 122*a* of a surface part of the cable 122 is also melted, but in this case, it is necessary to study a thickness and a quality of material of the sheath 122*a* on the assumption that the sheath 122*a* is melted due to the ultrasonic welding when the sheath 122*a* of the cable 122 is designed and selected, so that it becomes a restriction at the time of designing a wire harness. In particular, with regard to a thickness of the sheath 122*a*, it is necessary that the sheath 122*a* is designed to have a thickness thicker than usual on the assumption that the sheath 122*a* is melted due to the ultrasonic welding.

Therefore, it is an object of the invention to provide a wire harness that is capable of sufficiently maintaining air-tightness between a housing of a connector and a cable without melting a sheath of the cable as much as possible and a method of manufacturing the wire harness.

(1) According to one embodiment of the invention, a wire harness comprises:

a plurality of cables arranged in parallel; and a connector comprising a housing to which end portions of the plurality of cables are connected, wherein the housing comprises an air-tight block at a side thereof that the plurality of cables are connected, the air-tight block comprising a plurality of cable insertion holes formed in parallel through which the plurality of cables are inserted into the housing, wherein the cable insertion holes are formed to have a gap with a predetermined distance between the cables and the air-tight block, two adjacent ones of the cable insertion holes being formed to overlap with each other and to communicate with each other, wherein the air-tight block further comprises two closing parts for closing a space between the air-tight block and the cables at two places along a longitudinal direction of the cables, and for defining a part of the cable insertion hole, an insertion part into which a melting member formed of a resin is inserted without pressing the cables, and which communicates with the cable insertion hole between the closing parts, a press receiving part formed in an inner wall surface of the insertion part or the cable insertion hole, for allowing a forward end of the melting member inserted to be pressed, and an air escape opening part that opens from the cable insertion hole between the closing parts toward an outside of the air-tight block, and wherein air-tightness between the air-tight block and the cables is maintained by:

a first step that the melting member is inserted into the insertion part, and the melting member is vibrated and pressed to the press receiving part so that a forward end portion of the melting member in contact with the press receiving part is melted into a melt resin, the melt resin is poured into the gap between the closing parts, and a periphery of the cables is covered with the melt resin;

a second step that the air escape opening part is closed; and a third step that the melting member is pressed so as to be melted, so that the cables are pressed by the melt resin poured into the gap between the closing parts.

In the above embodiment (1) of the invention, the following modifications and changes can be made.

(i) The insertion part is formed in the air-tight block between the closing parts and on an end portion side of the cables.

(ii) The insertion part comprises a first insertion part formed to allow the melting member to be inserted into a part that the adjacent cable insertion holes communicate with each other.

(iii) The insertion part comprises a second insertion part into which the melting member is inserted, and which communicates with two at both ends of the plurality of cable insertion holes arranged in parallel.

(iv) The air-tight block is formed of a resin, and the melting member has a melting temperature lower than the air-tight block.

(v) The air-tight block is formed of a resin, the melting member and the air-tight block are formed of a material equal to each other or materials of which melting temperatures are close to each other, and a metal member or a high melting point member formed of a resin of which a melting temperature is higher than the melting member is installed in the press receiving parts against which the melting member is pressed.

(vi) The closing part comprises a sandwiching part for sandwiching the cables so as to keep the gap formed on the periphery of the cables to have a predetermined distance.

(vii) The air-tight block is formed of a pair of division air-tight blocks that is formed of a resin, and is divided into two pieces so as to vertically sandwich the plurality of cables arranged in parallel, and on the condition that the plurality of cables are sandwiched between the pair of division air-tight blocks, the pair of division air-tight blocks is welded by ultrasonic welding so as to be integrated.

(viii) The plurality of insertion parts and the plurality of press receiving parts are formed and the melting member is inserted into the plurality of insertion parts, respectively, and the plurality of melting members inserted into the plurality of insertion parts are pressed simultaneously.

(2) According to another embodiment of the invention, a method of manufacturing a wire harness comprising a plurality of cables arranged in parallel, and a connector comprising a housing to which end portions of the plurality of cables are connected, wherein the housing comprises an air-tight block at a side thereof that the plurality of cables are connected, the air-tight block comprising a plurality of cable insertion holes formed in parallel through which the plurality of cables are inserted into the housing, wherein the cable insertion holes are formed to have a gap with a predetermined distance between the cables and the air-tight block, two adjacent ones of the cable insertion holes being formed to overlap with each other and to communicate with each other, and wherein the air-tight block further comprises two closing parts for closing a space between the air-tight block and the cables at two places along a longitudinal direction of the cables, and for defining a part of the cable insertion hole, an insertion part into which a melting member formed of a resin is inserted without pressing the cables, and which communicates with the cable insertion hole between the closing parts, a press receiving part formed in an inner wall surface of the insertion part or the cable insertion hole, for allowing a forward end of the melting member inserted to be pressed, and an air escape opening part that opens from the cable insertion hole between the closing parts toward an outside of the air-tight block, the method comprises:

a first step that the melting member is inserted into the insertion part, and the melting member is vibrated and pressed to the press receiving part so that a forward end portion of the melting member in contact with the press receiving part is melted into a melt resin, the melt resin is poured into the gap between the closing parts, and a periphery of the cables is covered with the melt resin;

a second step that the air escape opening part is closed; and a third step that the melting member is pressed so as to be melted, so that the cables are pressed by the melt resin poured into the gap between the closing parts, in order to maintain air-tightness between the air-tight block and the cables.

Points of the Invention

According to one embodiment of the invention, a wire harness is constructed such that the air-tightness between an air-tight block and cables is maintained by: the first step that a melting member is inserted into a cable insertion hole between two sandwiching parts via the first insertion part, and the melting member is vibrated and pressed to a first press receiving part so that a forward end portion of the melting member in contact with the press receiving part is melted into a melt resin, the melt resin is poured into a gap between the sandwiching parts, and the periphery of the cables is covered with the melt resin, the second step that an air escape opening part is closed, and the third step that the melting member is further pressed so as to be melted, so that the cables are pressed by the melt resin poured into the gap. In addition, the air escape opening part is formed in the cable insertion hole and between of the sandwiching parts, and the melt resin is poured into the gap between the sandwiching parts while the air is allowed to escape through the air escape opening part. Thereby, a problem can be prevented that when the melt resin is poured into the gap, the air stored in the gap between the sandwiching parts causes a part of the cables being not covered with the melt resin.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Figure 1:
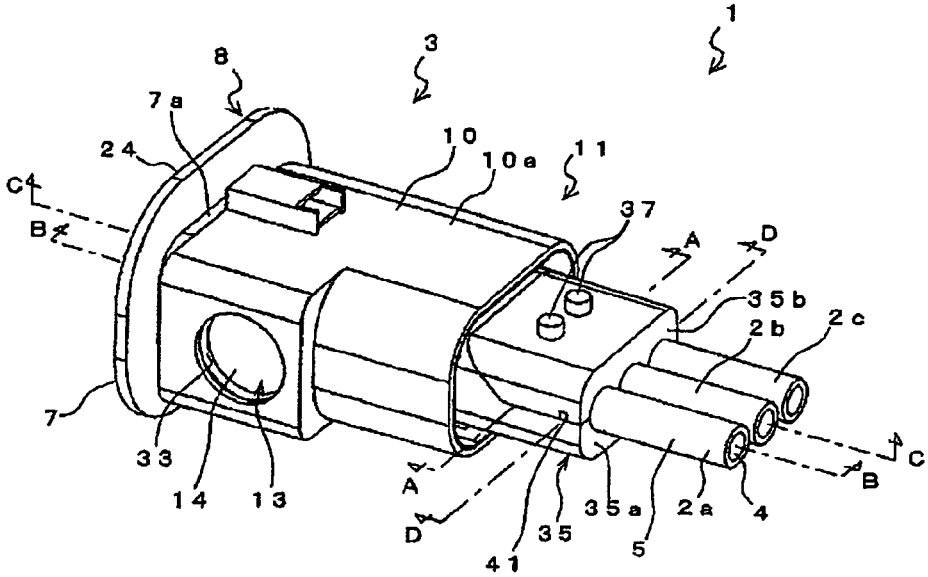
FIG. 1 is a perspective view schematically showing a wire harness according to one embodiment of the invention.

The preferred embodiments according to the invention will be explained below referring to the drawings.

Figure 2:
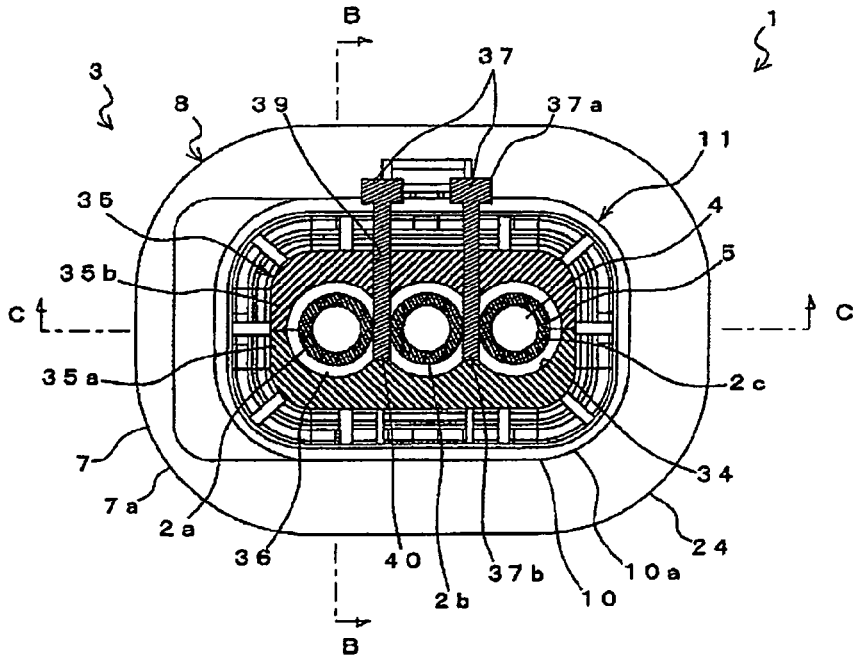
FIG. 2 is a cross-sectional view taken along the line A-A in FIG. 1.
Figure 3:
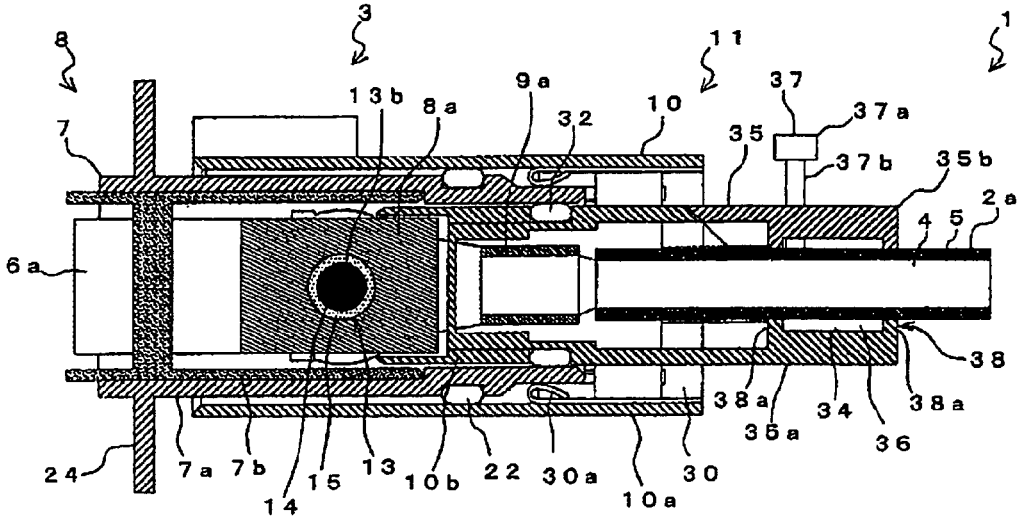
FIG. 3 is a cross-sectional view taken along the line B-B in FIG. 1.
Figure 4:
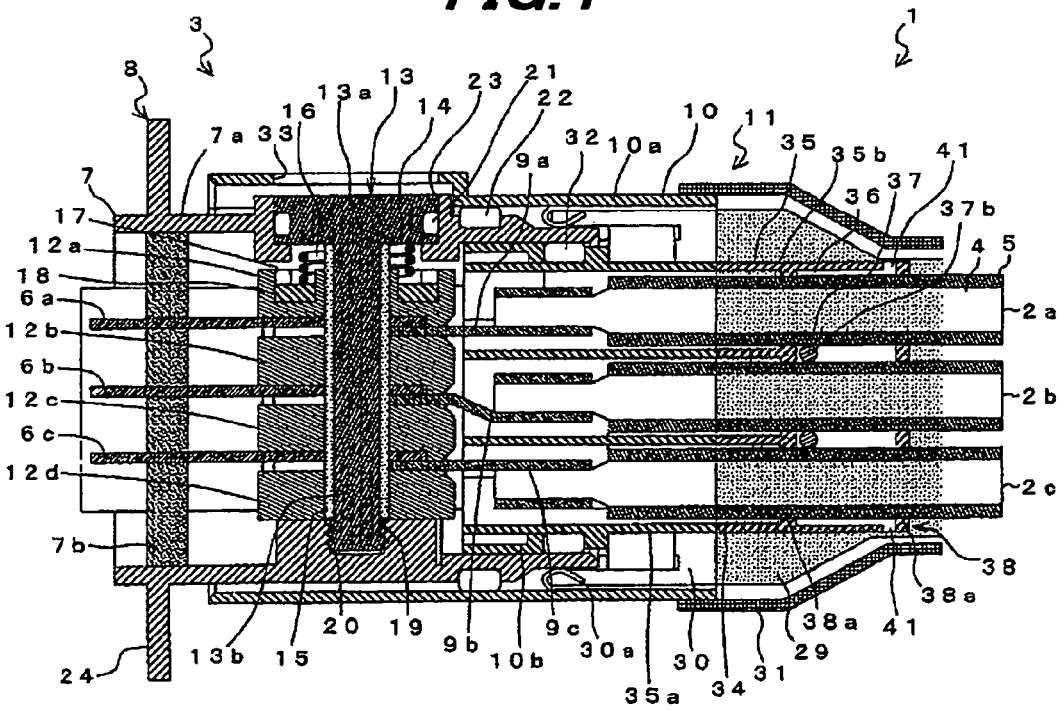
FIG. 4 is a cross-sectional view taken along the line C-C in FIG. 1.
Figure 5:
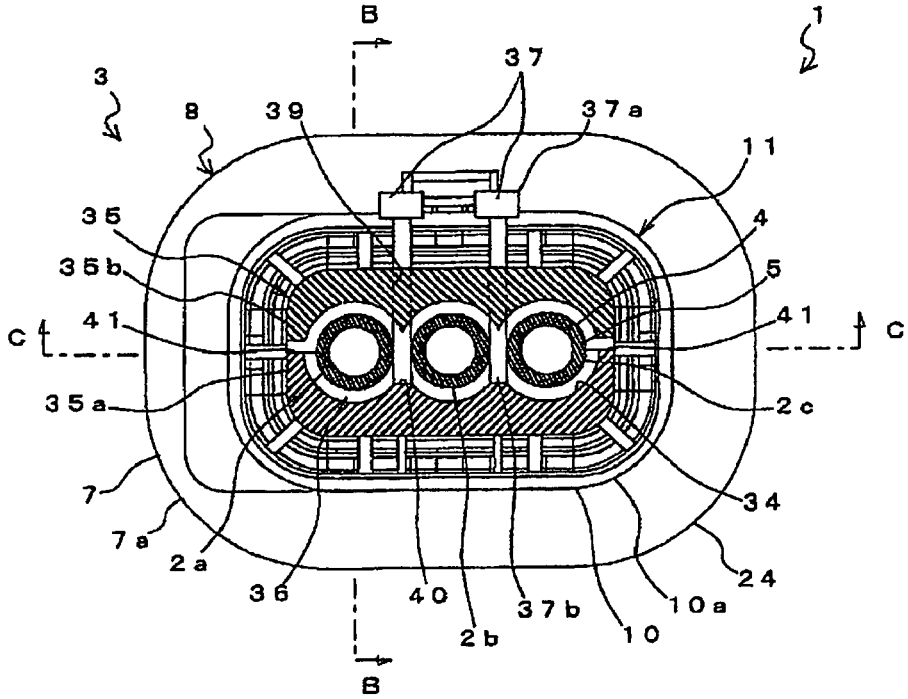
FIG. 5 is a cross-sectional view taken along the line D-D in FIG. 1.

FIG. 1 is a perspective view schematically showing a wire harness according to one embodiment of the invention, FIG. 2 is a cross-sectional view taken along the line A-A in FIG. 1, FIG. 3 is a cross-sectional view taken along the line B-B in FIG. 1, FIG. 4 is a cross-sectional view taken along the line C-C in FIG. 1, and FIG. 5 is a cross-sectional view taken along the line D-D in FIG. 1. Further, the detail will be explained later, but FIG. 1 shows a state after a melting member 37 is melted and FIGS. 2 to 5 show a state before the melting member 37 is melted.

As shown in FIGS. 1 to 5, a wire harness 1 includes a plurality of cables 2*a* to 2*c* arranged in parallel and a connector 3 to which end portions of the cables 2*a* to 2*c* are connected.

The wire harness 1 is used for, for example, a connection between a motor of a hybrid electric vehicle (HEV) and an inverter that drives the motor.

The cables 2*a* to 2*c* include a central conductor 4 formed of copper or aluminum, and a sheath 5 formed on a periphery of the central conductor 4. The cables 2*a* to 2*c* can be also configured to include an insulator, a shield conductor and the sheath 5 that are formed on the periphery of the central conductor 4 in this order. Electricity of different voltage and/or current is transmitted to each of the cables 2*a* to 2*c*. For example, in the embodiment, three cables 2*a* to 2*c* are used on the assumption of a power-supply line of three-phase alternating current for connection between a motor and an inverter, and alternating currents that have a different phase by 120 degrees with each other are transmitted to each of the three cables 2*a* to 2*c*.

The connector 3 includes a first connector part 8 having a first housing 7 in which a plurality (three) of first bonding terminals 6*a* to 6*c* are housed in alignment with each other, and a second connector part 11 having a second housing 10 in which a plurality (three) of second bonding terminals 9*a* to 9*c* are housed in alignment.

Further, in the embodiment, both of the housings 7, 10 are formed to have a structure that the first housing 7 is male and the second housing 10 is female when both of the connector parts 8, 11 are fitted into each other, but the male-female relation can be reversed, and a structure that the first housing 7 is female and the second housing 10 is male can be also adopted.

In the embodiment, a case that the first connector part 8 is connected to a side of a device such as a motor, an inverter, and the second connector part 11 is connected to a side of cables 2*a* to 2*c*, and the device such as a motor, an inverter and the cables 2*a* to 2*c* are connected to each other at the connector 3 will be explained. Namely, in the embodiment, an air-tightness maintaining structure between the cables 2*a* to 2*c* and the housing (the second housing 10) is installed in the second connector part 11.

Here, prior to an explanation of the air-tightness maintaining structure in the embodiment, the connector 3 will be explained. Further, a structure of the connector 3 explained here is a just example, the invention does not limited to this.

In the embodiment, as the connector 3, a connector is used, that has a structure that when first connector part 8 and second connector part 11 are fitted into each other, each of one surfaces of the plurality of first connecting terminals 6*a* to 6*c* and each of one surfaces of the plurality of second connecting terminals 9*a* to 9*c* face each other so that they form a pair with each other, and simultaneously the plurality of the first connecting terminals 6*a* to 6*c* and the plurality of the second connecting terminals 9*a* to 9*c* are alternately arranged so that a stacked state is formed. It is a so-called stack structure type connector.

First, the first connector part 8 will be explained.

The first connector part 8 includes the first housing 7 in which three first bonding terminals 6*a* to 6*c* are housed in alignment with each other, a plurality of insulation members 12*a* to 12*d* having a nearly rectangular parallelepiped shape, for insulating each of the first connecting terminals 6*a* to 6*c* housed in the first housing 7, and a connection member 13 that has a head part 13*a* and an shaft part 13*b* connected to the head part 13*a*, is configured to allow the shaft part 13*b* to pass through each of the contacts according to the plurality of first connecting terminals 6*a* to 6*c* and the plurality of second connecting terminals 9*a* to 9*c*, and the plurality of insulation members 12*a* to 12*d*, and simultaneously to allow the head part 13*a* to press the insulation member 12*a* adjacent to the head part 13*a*, so as to collectively fixes and electrically connects the plurality of first connecting terminals 6*a* to 6*c* and the plurality of second connecting terminals 9*a* to 9*c* at each of the contacts, and at least the parts passing through each of the contacts are formed of an insulating material.

The first housing 7 includes a first outer housing 7*a* and a first inner housing 7*b* for holding the first bonding terminals 6*a* to 6*c* in the first outer housing 7*a*.

It is preferable that the first outer housing 7*a* is formed of metal such as aluminum having a high electric conductivity, a high heat conductivity and a light weight in view of shield performance, radiation properties and reduction in weight of the connector 3, but it can be formed of a resin or the like. In the embodiment, the first outer housing 7*a* is formed of aluminum.

It is preferable that the first inner housing 7*b* is formed of an insulating resin such as polyphenylene sulfide (PPS) resin, polyphthalamide (PPA) resin, polyamide (PA) resin, polybutylene terephthalate (PBT) resin.

The first connecting terminals 6*a* to 6*c* are such that have a plate-like shape and are formed of metal having high electric conductivity such as silver, copper, aluminum. The first connecting terminals 6*a* to 6*c* are held in the first outer housing 7*a* in alignment with each other and apart from each other at predetermined intervals by the first inner housing 7*b*. Each of the first connecting terminals 6*a* to 6*c* has a certain degree of flexibility.

Figure 6:
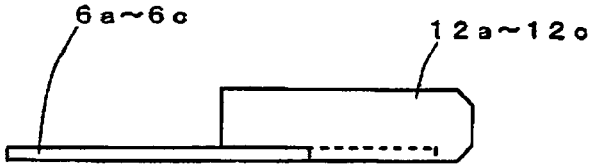
FIG. 6 is a side view schematically showing a first bonding terminal in the wire harness shown in FIG. 1.

As shown in FIG. 6, the insulation members 12*a* to 12*c* are fixed to a surface of each of the first connecting terminals 6*a* to 6*c* opposite to a surface to be bonded to the second bonding terminals 9*a* to 9*c*. In addition, the second insulation member 12*d* is fixed to an inner surface of the first outer housing 7*a* so as to face a surface opposite to a surface to be bonded to the first bonding terminal 6*c* of the second bonding terminal 9*c* that locates at the outermost position when the first bonding terminals 6*a* to 6*c* and the second bonding terminal 9*a* to 9*c* are stacked. Each of the insulation members 12*a* to 12*d* are fixed in such a position that they project to a side of the forward ends of the first bonding terminals 6*a* to 6*c*, and the insulation members 8*a* to 8*d* are chamfered at the corners located at the side into (from) which the second bonding terminals 9*a* to 9*c* are inserted (removed) in order to enhance insertion property of the second bonding terminals 9*a* to 9*c*. Further, in FIG. 6, the first insulation members 12*a* to 12*c* are shown by simplifying the structure thereof and the first insulation members 12*a* to 12*c* are shown in the same fashion.

The connection member 13 includes a bolt 14 formed of metal such as SUS, iron, copper alloy and an insulation layer 15 formed by that a periphery of the shaft part 13*b* is coated with an insulating resin as an insulating material such as polyphenylene sulfide (PPS) resin, polyphthalamide (PPA) resin, polyamide (PA) resin, polybutylene terephthalate (PBT) resin. Further, a concave portion not shown into which a hexagonal wrench (also referred to as an open-end wrench) is fitted.

An elastic member 16 is installed between a lower surface of the head part 13*a* of the connection member 13 and an upper surface of the first insulation member 12*a* arranged directly below the head part 13*a*, the elastic member 16 being used for applying a predetermined pressing force to the first insulation member 12*a*. Here, the elastic member 16 is formed of, for example, a spring of metal such as SUS. In an upper surface of the first insulation member 12*a* with which the lower portion of the elastic member 16 comes into contact, a concave portion 17 housing the lower portion of the elastic member 16 is formed, and in a bottom portion of the concave portion 17 (namely, a seat portion with which the lower portion of the elastic member 16 comes into contact), a receiving member 18 of metal such as SUS is installed, the receiving member 18 being used for receiving the elastic member 16 and preventing the first insulation member 12*a* f from being damaged.

The connection member 13 is inserted into the first outer housing 7*a* from a side of the surfaces of the first bonding terminals 6*a* to 6*c* (FIG. 4 shows as a side of the upper surfaces) to which the first insulation members 12*a* to 12*c* are fixed, and presses them from the head part 13*a* toward the forward end of the shaft part 13*b* of the connection member 13 (FIG. 4 shows as from the upper portion toward the lower portion) by that the screw part 19 located at the forward end of the shaft part 13*b* is screwed to a threaded screw hole 20 formed on an inner peripheral surface of the first outer housing 7*a*, and collectively fixes and electrically connects the first bonding terminals 6*a* to 6*c* and the second bonding terminals 96*a* to 9*c* at each of the contacts.

In a periphery of the head part 13*a* of the connection member 13, a packing 21 for preventing water from entering into the first outer housing 7*a* is installed. In addition, in a peripheral part of the first outer housing 7*a*, a packing 22 for coming into contact with an inner peripheral surface of the second housing 10 (the second outer housing 10*a*) when both of the connector parts 8, 11 are fitted into each other is installed.

In an upper part of the first outer housing 7*a* (FIG. 4 shows as an upper side), a connection member insertion hole 23 into which the connection member 13 is inserted is formed. The connection member insertion hole 23 is formed so as to have a tubular shape and the lower end portion (FIG. 4 shows as a lower side) of the tubular shape is folded interiorly. A peripheral edge part of a lower surface of the head part 13*a* of the connection member 13 comes into contact with the folded part, so that stroke of the connection member 13 can be controlled.

In an periphery of the first outer housing 7*a*, a flange 24 (mounting holes are not shown) for fixing the first connector part 8 to a case body such as a device, for example, a shield case of a motor or an inverter is formed. When the first connector part 8 is connected to a motor or an inverter, the flange 24 is fixed to the shield case of the motor or the inverter, and simultaneously portions of the first bonding terminals 6*a* to 6*c* exposed from the first housing 7 is connected to each terminal in a terminal block installed in the shield case of the motor or the inverter. The first connector parts 8 are connected to both of the motor and the inverter respectively and the second connector parts 11 installed in both end portions of the cable 2*a* to 2*c* are fitted into both of the first connector parts 8 respectively, so that the motor and the inverter are electrically connected to each other via the wire harness 1.

Next, the second connector part 11 will be explained.

The second connector part 11 includes a second housing 10 in which the plurality (three) of second bonding terminals (female terminal) 9*a* to 9*c* are housed in alignment with each other. The second bonding terminals 9*a* to 9*c* are electrically connected to the end portions of the cables 2*a* to 2*c*.

The second housing 10 includes the second outer housing 10*a* and a second inner housing 10*b* that has a multiple tubular shape, namely a shape that a plurality of tubes are connected to each other, has an air-tight block 35 described below, and holds the cables 2*a* to 2*c* in the second outer housing 10*a* so that the cables 2*a* to 2*c* are in alignment with each other and apart from each other at predetermined intervals.

It is preferable that the second outer housing 10*a* is formed of metal such as aluminum having a high electric conductivity, a high heat conductivity and a light weight in view of shield performance, radiation properties and reduction in weight of the connector 1, but it can be formed of a resin or the like. In the embodiment, the second outer housing 10*a* is formed of an insulating resin.

It is preferable that the second inner housing 10*b* (an air-tight block 35 described below is also included) is formed of an insulating resin such as polyphenylene sulfide (PPS) resin, polyphthalamide (PPA) resin, polyamide (PA) resin, polybutylene terephthalate (PBT) resin.

The second connecting terminals 9*a* to 9*c* are formed of metal having high electric conductivity such as silver, copper, aluminum. Each of the second bonding terminals 9*a* to 9*c* is held in the second outer housing 10*a* in alignment with each other and apart from each other at predetermined intervals by holding the cables 2*a* to 2*c* (that are located at positions adjacent to the second bonding terminals 9*a* to 9*c*) at the second inner housing 10*b*. Each of the second bonding terminals 9*a* to 9*c* has a certain degree of flexibility.

Figure 7A:
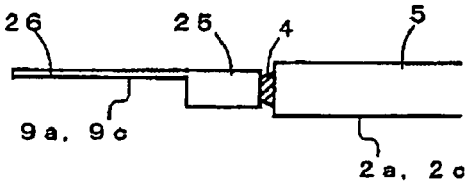
FIG. 7A is a side view schematically showing a second bonding terminal in the wire harness shown in FIG. 1.
Figure 7B:
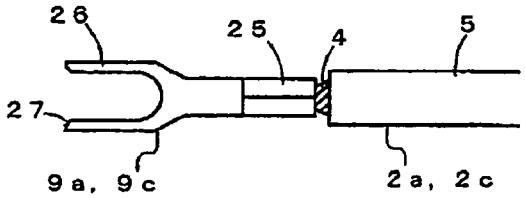
FIG. 7B is a bottom view schematically showing a second bonding terminal in the wire harness shown in FIG. 1.

As shown in FIG. 7, the second bonding terminals 9*a* to 9*c* arranged in both end portions at the time of the alignment include a swaging part 25 for swaging the conductive body 4 exposed from the forward end parts of the cables 2*a*, 2*c*, and a U-shaped contact 26 integrally formed with the swaging part 25. A tapered part 27 is formed in the forward end part of the U-shaped contact 26 for the purpose of enhancing insertion properties.

Figure 8A:
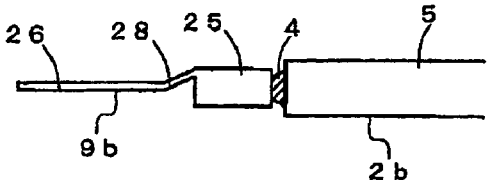
FIG. 8A is a side view schematically showing a second bonding terminal in the wire harness shown in FIG. 1.
Figure 8B:
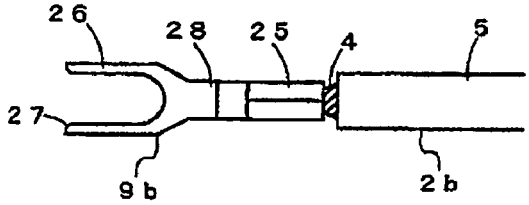
FIG. 8B is a bottom view schematically showing a second bonding terminal in the wire harness shown in FIG. 1.

As shown in FIG. 8, the second bonding terminal 9*b* arranged in a central portion at the time of the alignment includes a swaging part 25 for swaging the conductive body 4 exposed from the forward end part of the cable 2*b*, and a U-shaped contact 26 integrally formed with the swaging part 25 similarly to the second bonding terminals 9*a* to 9*c*, but the second bonding terminal 9*b* is configured to be folded at a body part 28 so that the U-shaped contact 26 is located on the central axis of the cable 2*b*. A tapered part 27 is formed in the forward end part of the U-shaped contact 26 for the purpose of enhancing insertion properties.

When the first connector part 8 and the second connector part 11 are fitted to each other, the U-shaped contact 26 is inserted so as to sandwich the shaft part 13*b* of the connection member 13. In the embodiment, the second bonding terminals 9*a*, 9*c* are arranged as the U-shaped contacts 26 thereof are located in a side of the second bonding terminal 9*b*, and a body part 28 of the second bonding terminal 9*b* that is arranged in the central portion at the time of the alignment is bent, so that the second bonding terminals 9*a* to 9*c* can be arranged apart from each other at the same intervals.

A braided shield 29 for enhancing a shield performance is wrapped around the parts of the cables 2*a* to 2*c* that are pulled out of the outer side terminal housing 10*a*. The braided shield 29 is brought into contact with a tubular shield body 30 described below and is electrically connected (has identical potentials (GND)) to the first outer housing 7*a* via the tubular shield body 30.

In addition to the above, a periphery of a side of another end of the second outer housing 10*a* out of which the cables 2*a* to 2*c* are pulled is covered with a rubber boot 31 so as to prevent water from entering into the second outer housing 10*a*. Further, the braided shield 29 and the rubber boot 31 are not shown in FIGS. 1 to 3 for the purpose of simplification of the drawings.

A packing 32 that comes into contact with the inner peripheral surface of the first outer housing 7*a* is installed on the peripheral part of the second inner housing 10*b*. Namely, the connector 3 is formed so as to have a double waterproof structure that includes the packing 22 installed on the peripheral part of the first outer housing 7*a* and the packing 32 installed on the peripheral part of the second inner housing 10*b*.

In addition, a connection member operation hole 33 is formed in the second outer housing 10*a*, the hole 40 being used for operating the connection member 13 installed in the first connector part 8 when both of the connector parts 8, 11 are fitted to each other.

In the embodiment, since the second outer housing 10*a* is formed of an insulating resin, in order to enhance shield performance and radiation properties, a tubular shield body 30 formed of aluminum is installed on the inner peripheral surface in a side of another end of the second outer housing 10*a*. The tubular shield body 30 has a contact part 30*a* for coming into contact with a periphery of the first outer housing 7*a* formed of aluminum when both of the connector parts 8, 11 are fitted to each other, and is thermally and electrically connected to the first outer housing 7*a* via the contact part 30*a*, and due to this, shield performance and radiation properties are enhanced.

Next, the connection of the first bonding terminals 6*a* to 6*c* and the second bonding terminals 9*a* to 9*c* using the connector 3 according to the embodiment will be explained.

When both of the connector parts 8, 11 are inserted into each other, each of the second bonding terminals 9*a* to 9*c* is inserted between each of the first bonding terminals 6*a* to 6*c* that form a pair with the second bonding terminals 9*a* to 9*c* and the insulation members 12*a* to 12*d*. And, due to the insertion, each of one surfaces of the first bonding terminals 6*a* to 6*c* and each of one surfaces of the second bonding terminals 9*a* to 9*c* face so as to form a pair with each other, and simultaneously the first bonding terminals 6*a* to 6*c*, the second bonding terminals 9*a* to 9*c* and the insulation members 12*a* to 12*d* are alternately arranged so as to form a stacked state. In this state, when the connection member 13 is operated through the connection member operation hole 33 and the screw part 19 of the connection member 13 is screwed to the threaded screw hole 20 of the first outer housing 7*a* so as to be fastened, the connection member 13 is pushed into a bottom part of the threaded screw hole 20 while rotated, and simultaneously the first insulation member 12*a*, the first insulation member 12*b*, the first insulation member 12*c* and the second insulation member 12*d* are pressed in this order by the elastic member 16, so that each of the contacts is pressed so as to be sandwiched between any two of the insulation members 12*a* to 12*d* and each of the contacts is brought into contact with each other in an insulated state. At this time, each of the first bonding terminals 6*a* to 6*c* and each of the second bonding terminals 9*a* to 9*c* are somewhat bent due to pressing force of the insulation members 12*a* to 12*d*, so as to be brought into contact with each other in a wide range.

Next, an air-tightness maintaining structure between the second housing 10 and the cables 2*a* to 2*c* that is a characteristic feature of the present invention will be explained.

The wire harness 1 includes an air-tight block 35 formed in a side which is a part of the second housing 10, more particular, a part of the second inner housing 10*b* and at which the plurality of cables 2*a* to 2*c* are connected, the air-tight block 35 having a plurality of cable insertion holes 34 formed in parallel, for allowing the plurality of cables 2*a* to 2*c* to be inserted into the second housing 10.

Incidentally, air-tightness between the second inner housing 10*b* and the second outer housing 10*a* is maintained when both of the connector parts 8, 11 are fitted into each other by two packings 22, 32, and further the air-tightness is maintained also by the rubber boot 31, so that the air-tight block 35 is installed in a state of air-tightness also to the second outer housing 10*a*.

The cable insertion holes 34 formed in the air-tight block 35 in parallel is formed to have a diameter larger than the cables 2*a* to 2*c*, and is formed to have a gap 36 with a predetermined distance between the cables 2*a* to 2*c* and the air-tight block 35. The gap 36 is a space into which a melt resin obtained when a melting member 37 described below is melted is poured, and the gap part 36 is formed to have a width being wide to such an extent that the melt resin can be positively poured. In addition, the cable insertion holes 34 are formed to be communicated with each other so that the cable insertion holes 34 adjacent to each other are stacked on each other. Namely, in the embodiment, the gaps 36 formed around the cables 2*a* to 2*c* adjacent to each other are communicated with each other.

In the air-tight block 35, two closing parts 38 for closing space between the air-tight block 35 and the cables 2*a* to 2*c* at two places along the longitudinal direction of the cables 2*a* to 2*c*, and defining a part of the cable insertion hole 34 are installed.

In the embodiment, as the closing part 38, a sandwiching part 38*a* is formed, for sandwiching the cables 2*a* to 2*c* so as to keep a distance between the cables 2*a* to 2*c* and the air-tight block 35 to be constant and to keep the gap 36 formed around the cables 2*a* to 2*c* to have a predetermined distance. The sandwiching part 38*a* is formed by that a part of the cable insertion hole 34 is reduced in diameter to almost the same diameter as the diameter of the cables 2*a* to 2*c* (a diameter slightly larger than the diameter of the cables 2*a* to 2*c*). In the embodiment, two sandwiching parts 38*a* are formed in a rear end portion of the air-tight block 35 in a longitudinal direction of the cables 2*a* to 2*c* and the melt resin is poured into the gap 36 between both of the sandwiching parts 38*a*. The gap 36 has a length between both of the sandwiching parts 38*a* (a length along a longitudinal direction of the cables 2*a* to 2*c*) of for example, 5 mm.

In addition, at least in the sandwiching parts 38*a*, the air-tight block 35 is formed to be divided into two pieces so as to be vertically (refer to FIGS. 1 and 3) sandwich the cables 2*a* to 2*c* arranged in parallel. This is a countermeasure against that it becomes difficult to insert the cables 2*a* to 2*c* into the air-tight block 35 (the cable insertion hole 34) due to the formation of the sandwiching parts 38*a*. In the embodiment, in order to divide the two sandwiching parts 38*a*, a part of the rear end portion of the air-tight block 35 (FIG. 3 shows as an upper right side) is divided, so as to be separately formed. Of the divided air-tight blocks 35, a part fixed to a side of the second outer housing 10*a* is referred to as a first division air-tight block 35*a* and a part that is divided from the first division air-tight block 35*a* so as to be separately formed is referred to as a second division air-tight block 35*b*. Prior to a process of melting the melting member 37, a pair of the division air-tight blocks 35*a*, 35*b* is melted due to the ultrasonic welding so as to be integrated with each other in a state that the cables 2*a* to 2*c* are sandwiched between a pair of the division air-tight blocks 35*a*, 35*b*.

In the air-tight block 35, a first insertion part 39 is formed as an insertion part that is a part into which the melting member 37 formed of a resin is inserted so as not to press the cables 2*a* to 2*c*, and is communicated with the cable insertion hole 34 between both of the sandwiching parts 38*a*. The first insertion part 39 is formed to allow the melting member 37 to be inserted into the cable insertion hole 34 between the cables 2*a* to 2*c* adjacent to each other, and is formed of a hole that passes through the second division air-tight block 35*b* in a perpendicular direction (FIG. 2 shows as a vertical direction) to a longitudinal direction of the cables 2*a* to 2*c*.

In the embodiment, since three cables 2*a* to 2*c* are arranged in parallel, a total of two first insertion parts 39 are formed, of which one is formed between the cable 2*a* and the cable 2*b* and another is formed between the cable 2*b* and the cable 2*c*, but is not limited to this, the number of the first insertion part 39 can be one or not less than three. In addition, in the embodiment, the two first insertion parts 39 are formed in the same position in a longitudinal direction of the cables 2*a* to 2*c*, but is not limited to this, the first insertion parts 39 can be formed in different positions in the longitudinal direction of the cables 2*a* to 2*c*, and for example, a plurality of the first insertion parts 39 can be formed between the cable 2*a* and the cable 2*b* in the longitudinal direction. The first insertion parts 39 is formed in the air-tight block 35 between both of the sandwiching parts 38*a* and in a side of an end portion of the cables 2*a* to 2*c* (a side of the second bonding terminals 9*a* to 9*c*).

In addition, in the air-tight block 35, a first press receiving part 40 is formed in an inner wall surface of the cable insertion hole 34 opposite to the first insertion part 39, as an insertion member for allowing a forward end of the melting member 37 inserted into the cable insertion hole 34 between both of the sandwiching parts 38*a* via the first insertion part 39 to be pressed. The first press receiving part 40 is formed of a flat surface formed perpendicularly to the insertion direction (FIG. 2 shows as a vertical direction) of the melting member 37 inserted via the first insertion part 39. In the embodiment, since two first insertion parts 39 are formed, two first press receiving parts 40 are formed corresponding to both first insertion parts 39. The two first press receiving parts 40 are formed in the same position in the insertion direction of the melting member 37.

In addition, in the air-tight block 35, an air escape opening part 41 that opens from the cable insertion hole 34 between both of the sandwiching parts 38*a* toward the outside of the air-tight block 35. The air escape opening part 41 is used for allowing an air existing in the gap 36 before the melt resin is poured when the melt resin is poured into the gap 36 between both of the sandwiching parts 38*a* to escape to the outside of the gap 36.

It is preferable that the air escape opening part 41 is formed at a location where the melt resin is filled finally when the melt resin is poured into the gap 36 between both of the sandwiching parts 38*a*. In the embodiment, the first insertion part 39 into which the melting member 37 is inserted is formed at a location between the cables 2*a* to 2*c* adjacent to each other and in a side of an end portion of the cables 2*a* to 2*c* (FIGS. 3, 4 show as a left side), so that the air escape opening part 41 is formed at a location where the melt resin is filled finally, namely at a location in an insertion side of the cables 2*a* to 2*c* (FIGS. 3, 4 show as a right side) and in side surfaces of the air-tight block 35 (FIG. 4 shows as top and bottom surfaces, and FIG. 5 shows as right and left surfaces), along the parallel arrangement direction of the cables 2*a* to 2*c*.

The melting member 37 is formed to have a pin shape including a shaft part 37*b* of a columnar shape inserted into the first insertion part 39 and a head part 37*a* of a flange shape formed in a rear end portion of the shaft part 37*b*.

The melting member 37 is configured to have a composition that a forward end portion of the shaft part 37*b* is inserted into the first insertion part 39, and in a state that a horn (not shown) is brought into contact with the head part 37*a*, the forward end portion of the shaft part 37*b* is vibrated by the horn and simultaneously is pressed to the first press receiving part 40, so that the forward end portion of the shaft part 37*b* is melted. At this time, in order to prevent the first press receiving part 40 (namely the air-tight block 35) from being melted, as the melting member 37, a resin is used, that has a melting temperature (melting point) lower than the air-tight block 35. The resin used for the melting member 37 includes, for example, polyphenylene sulfide (PPS) resin, polyphthalamide (PPA) resin, polyamide (PA) resin, polybutylene terephthalate (PBT) resin.

Since the head part 37*a* of the melting member 37 becomes a part with which the horn is brought into contact when the melting member 37 is melted, in order to prevent the head part 37*a* from being melted due to heat generation between the horn and the head part 37*a* when the melting member 37 is melted, the head part 37*a* is formed to have a largeness (area) sufficient to ensure a contact area with the horn.

The shaft parts 37*b* of the melting member 37 are formed to have a diameter equal to or less than a distance between the cables 2*a* to 2*c* adjacent to each other. In the embodiment, the shaft parts 37*b* are formed to have a diameter equal to the distance between the cables 2*a* to 2*c* adjacent to each other. Due to this, when the melting member 37 is inserted into the first insertion part 39, the shaft parts 37*b* are brought into contact with the cables 2*a* to 2*c* (sheath 5), but the insertion direction of the melting member 37 is perpendicular to the parallel arrangement direction, so that the sheath 5 is prevented from being pressed and the sheath 5 is also prevented from being melted due to the heat generation between the shaft parts 37*b* and the sheath 5. The shaft part 37*b* of the melting member 37 has a diameter of, for example, 1 to 2 mm.

The shaft parts 37*b* of the melting member 37 is set to have such a length that an amount of the melt resin to be melted becomes such an extent that the gap 36 is perfectly filled with the melt resin or the amount becomes somewhat larger than the extent. In addition, in the embodiment, two first insertion parts 39 and two first press receiving part 40 are formed, and two melting member 37 are used, and the two melting member 37 are formed to have almost the same length. The reason why this composition is adopted that generally, in order to supply the melt resin to the gap 36 uniformly, it is preferable that the two melting members 37 are melted at almost the same speed, and in the embodiment, due to this, by adopting the above-mentioned composition that the two melting member 37 are formed to have almost the same length, the above-mentioned preferable composition "the two melting members 37 are melted at almost the same speed" can be realized by a simple mechanism that the two melting members 37 are pressed simultaneously. Further, in order that the two melting members 37 are pressed simultaneously, for example, they can be pressed by one horn in common.

In the embodiment, the melting members 37 are formed to have a pin shape, but the shape of the melting member 37 is not limited to this, for example, the melting member 37 can be formed to have a plate-like shape. In addition, the shaft parts 37*b* of the melting member 37 can be formed to have a taper shape that tapers toward the forward end thereof gradually for the purpose that the forward end portion is easily melted.

Next, a method of manufacturing the wire harness 1 will be explained.

When the wire harness 1 is manufactured, first, end portions of the cables 2*a* to 2*c* in which the second bonding terminals 9*a* to 9*c* are installed are inserted into the cable insertion holes 34 of the first division air-tight block 35*a*, and the respective cables 2*a* to 2*c* are held in the second outer housing 10*a* in alignment with each other and apart from each other at predetermined intervals by the second inner housing 10*b*.

After that, the second division air-tight block 35*b* is welded to the first division air-tight block 35*a* due to ultrasonic welding, and a pair of the division air-tight blocks 35*a*, 35*b* is integrated and simultaneously the cables 2*a* to 2*c* are sandwiched between the sandwiching parts 38*a*.

At this time, a horn is brought into contact with the second division air-tight block 35*b*, the second division air-tight block 35*b* is vibrated and simultaneously pressed in a side of the first division air-tight block 35*a* by the horn, and the pair of the division air-tight blocks 35*a*, 35*b* is welded, but if the second division air-tight block 35*b* is excessively pressed in a side of the first division air-tight block 35*a* at the time of the ultrasonic welding, the sandwiching parts 38*a* are pressed by the sheath 5, heat is generated at the contact part of the sandwiching parts 38*a* and the sheath 5, so that the sheath 5 may be melted. Consequently, the embodiment is configured to have a composition that the pressing by the horn is stopped at the time when the sandwiching parts 38*a* are adhered to the sheath 5 to such an extent that the melt resin is prevented from being leaked.

After the pair of the division air-tight blocks 35*a*, 35*b* is integrated with each other due to the ultrasonic welding, a resin filling process that the melt resin is poured into the gap 36 between both of the sandwiching parts 38*a* is carried out.

Figure 9:
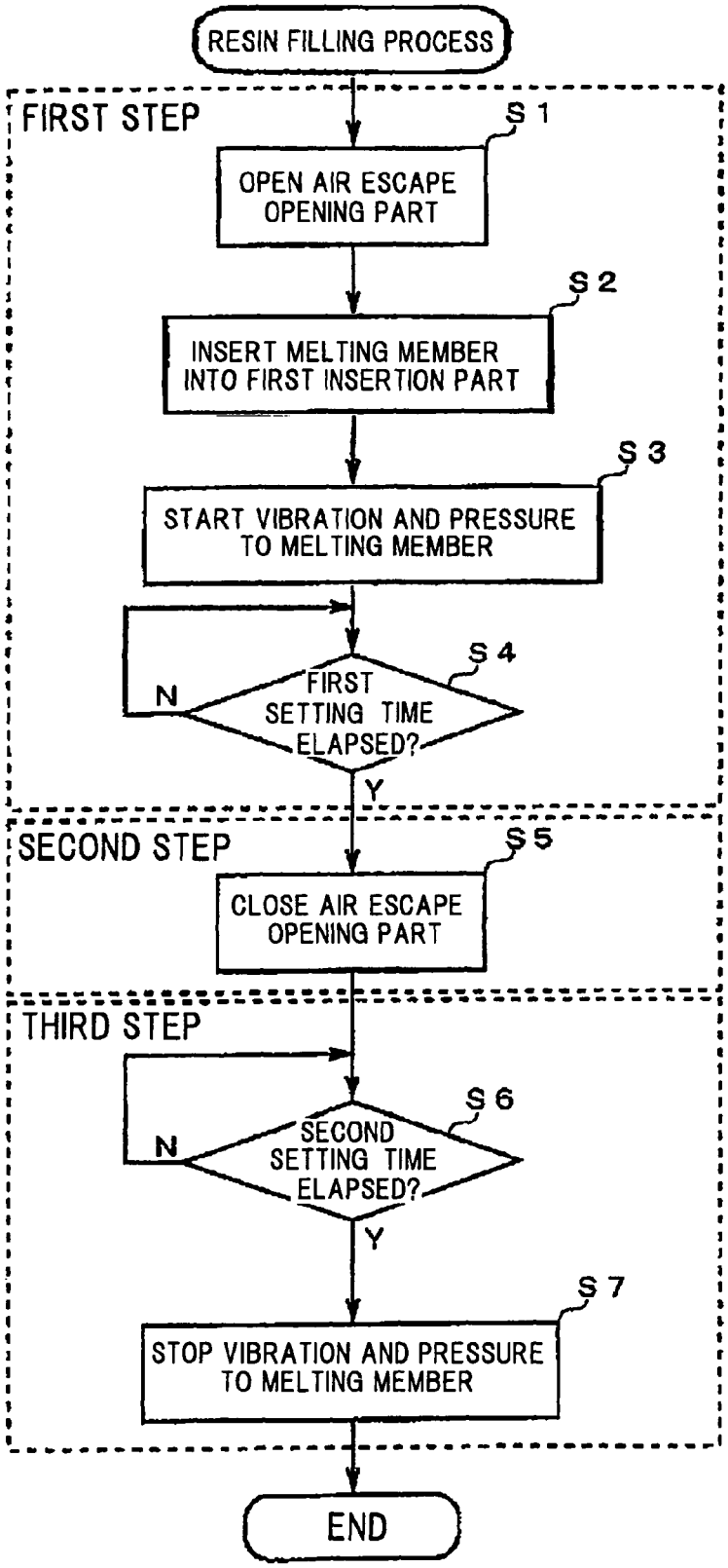
FIG. 9 is a flowchart schematically showing a procedure for manufacturing the wire harness shown in FIG. 1.

As shown in FIG. 9, the resin filling process includes a first step that the melting member 37 is inserted into the cable insertion hole 34 between both of the sandwiching parts 38*a* via the first insertion part 39, and the melting member 37 is vibrated and simultaneously pressed to the first press receiving part 40 so that a forward end portion of the melting member 37 that comes into contact with the press receiving part 40 is melted, the melt resin that is the melting member 37 melted is poured into the gap 36 between both of the sandwiching parts 38*a*, and peripheries of the cables 2*a* to 2*c* are covered with the melt resin, the second step that the air escape opening part 41 is closed, and a third step that the melting member 37 is further pressed so as to be melted, so that the cables 2*a* to 2*c* are pressed by the melting resin poured into the gap 36 between both of the sandwiching parts 38*a*.

Hereinafter, each step of the resin filling process will be explained in detail.

Figure 10A:
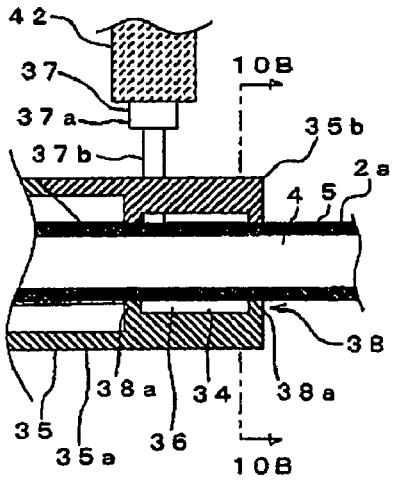
FIG. 10A is a longitudinal cross-sectional view schematically showing a state that a melting member is inserted into a first insertion part, in an explanation of a manufacturing method of the wire harness shown in FIG. 1.
Figure 10B:
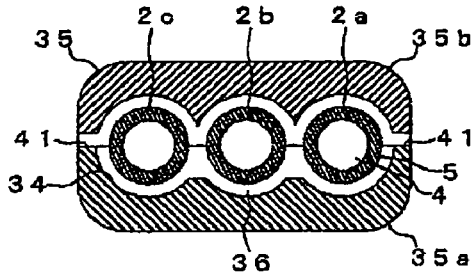
FIG. 10B is a cross-sectional view taken along the line 10B-10B in FIG. 10A.

In the first step of the resin filling process, first, the air escape opening part 41 is opened (Step S1), and the melting member 37 is inserted into the first insertion part 39 (Step S2). Cross-sections of main part of the wire harness 1 at the above-mentioned time are shown in FIGS. 10A, 10B. As shown in FIGS. 10A, 10B, a horn 42 is brought into contact with the head part 37*a* of the melting member 37.

After that, vibration and pressurization of the melting member 37 are started by the horn 42 (Step S3). When the melting member 37 is vibrated and simultaneously is pressed to the first press receiving part 40, heat is generated between a forward end of the shaft part 37*b* of the melting member 37 and the first press receiving part 40, so that the forward end of the shaft part 37*b* of the melting member 37 is melted. A melt resin obtained by that the forward end of the shaft part 37*b* of the melting member 37 is melted is poured into the gap 36 (the gap 36 between both of the sandwiching parts 38*a*) formed around the cables 2*a* to 2*c*. Further, at this time, two melting members 37 are pressed by the horn 42 simultaneously.

After the vibration and pressurization of the melting member 37 are started by the horn 42, waiting for an elapse of a first setting time set preliminarily is carried out (Step S4). Namely, in the Step S4, the waiting is carried out until a time counted from the start of the vibration and pressurization of the melting member 37 reaches the first setting time set preliminarily. This first setting time is a time for waiting for that the gap 36 between both of the sandwiching parts 38*a* is perfectly filled with the melt resin. Cross-sections of main part of the wire harness 1 when the gap 36 between both of the sandwiching parts 38*a* is perfectly filled with the melt resin are shown in FIGS. 11A, 11B.

Figure 11A:
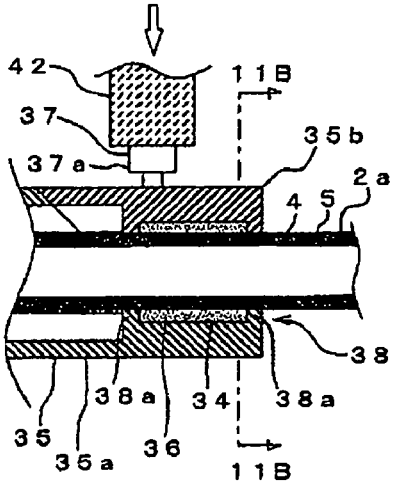
FIG. 11A is a longitudinal cross-sectional view schematically showing a state that a melting resin is filled in the gap between both of the sandwiching parts, in an explanation of a manufacturing method of the wire harness shown in FIG. 1.
Figure 11B:
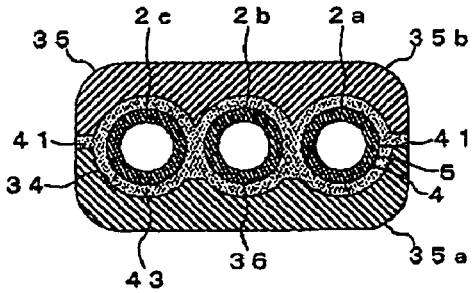
FIG. 11B is a cross-sectional view taken along the line 11B-11B in FIG. 11A.

As shown in FIGS. 11A, 11B, when the vibration and pressurization of the melting member 37 are continued, the forward end of the shaft part 37*b* of the melting member 37 is melted sequentially and is poured into the gap 36, so that the gap 36 between both of the sandwiching parts 38*a* is perfectly filled with the melt resin 43. When the first setting time elapses and the gap 36 between both of the sandwiching parts 38*a* is perfectly filled with the melt resin 43, the first step is completed and moves into the second step.

In the second step, the air escape opening part 41 is closed (Step S5). Cross-sections of main part of the wire harness 1 at the above-mentioned time are shown in FIGS. 12A, 12B.

Figure 12A:
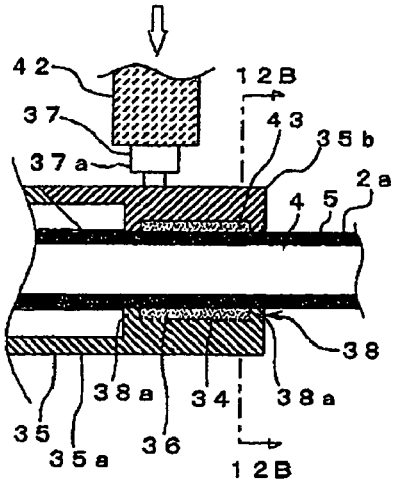
FIG. 12A is a longitudinal cross-sectional view schematically showing a state that an air escape opening part is closed by a closing part, in an explanation of a manufacturing method of the wire harness shown in FIG. 1.
Figure 12B:
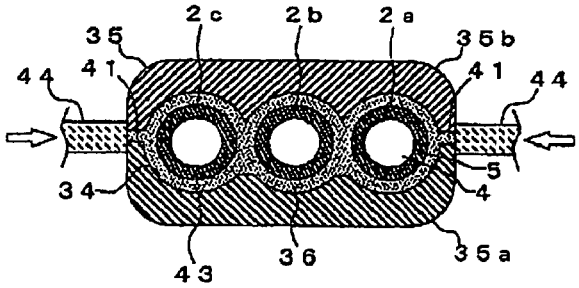
FIG. 12B is a cross-sectional view taken along the line 12B-12B in FIG. 12A.

As shown in FIGS. 12A, 12B, in the embodiment, since the air escape opening part 41 is formed in side surfaces of the air-tight block 35 (FIG. 12B shows as right and left surfaces), closing members 44 are pushed from both sides of the air-tight block 35, so that the air escape opening part 41 is closed.

When the air escape opening part 41 is closed by the closing members 44, the second step is completed and moves into the third step.

In the third step, after the air escape opening part 41 is closed in the second step, the vibration and pressurization of the melting member 37 by the horn 42 are further continued, and waiting for an elapse of a second setting time set preliminarily is carried out (Step S6). Namely, in the Step S6, the waiting is carried out until a time counted from the closing of the air escape opening part 41 reaches the second setting time set preliminarily. This second setting time is a time for waiting for that an inner pressure of the melt resin 43 poured into the gap 36 between both of the sandwiching parts 38*a* is heightened and the cables 2*a* to 2*c* are pressed by the melt resin 43. Cross-sections of main part of the wire harness 1 when the cables 2*a* to 2*c* are pressed by the melt resin 43 are shown in FIGS. 13A, 13B.

Figure 13A:
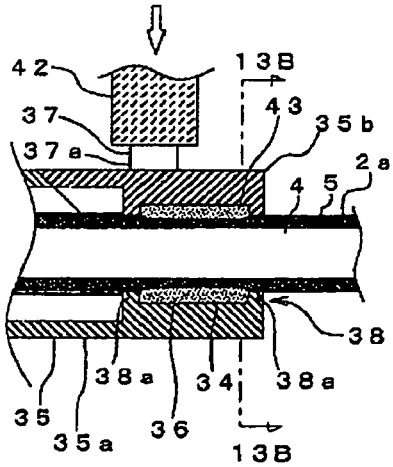
FIG. 13A is a longitudinal cross-sectional view schematically showing a state that an inner pressure of the melt resin is heightened so as to allow a sheath of cables to be pressed, in an explanation of a manufacturing method of the wire harness shown in FIG. 1.
Figure 13B:
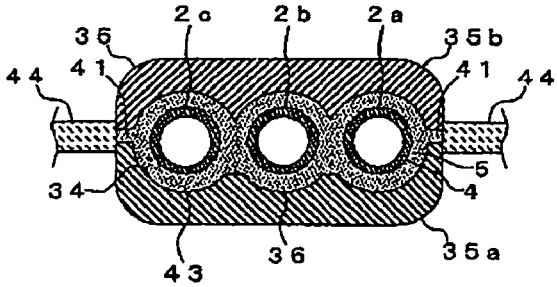
FIG. 13B is a cross-sectional view taken along the line 13B-13B in FIG. 13A.

As shown in FIGS. 13A, 13B, when the air escape opening part 41 is closed, the melt resin 43 is trapped in the gap 36 between both of the sandwiching parts 38*a*. In this state, when the vibration and pressurization of the melting member 37 by the horn 42 are further continued, the inner pressure of the melt resin 43 is heightened and the sheath 5 of the cables 2*a* to 2*c* is pressed by the melt resin 43 so as to be reduced in diameter. Further, at the time, the head part 37*a* of the melting member 37 comes into contact with a peripheral edge of the first insertion part 39 and the head part 37*a* is also welded to the air-tight block 35.

After that, the vibration and pressurization of the melting member 37 by the horn 42 are stopped (Step S7). And then, the melt resin 43 with which the cables 2*a* to 2*c* are covered is solidified, the melting member 37 and the air-tight block 35 are integrated. The head part 37*a* of the melting member 37 protruding from the air-tight block 35 can be scraped or can be left as it stands.

Due to the method mentioned above, an air-tight maintaining structure between the second housing 10 and the cables 2*a* to 2*c* is formed, and the wire harness 1 is obtained. Further, since a combination procedure of the first connector part 8 is included in a conventional technique, here, the explanation is omitted.

As explained above, in the wire harness 1 according to the embodiment, the air-tightness between the air-tight block 35 and the cables 2*a* to 2*c* is maintained via such three steps as, the first step that the melting member 37 is inserted into the cable insertion hole 34 between both of the sandwiching parts 38*a* via the first insertion part 39, and the melting member 37 is vibrated and simultaneously pressed to the first press receiving part 40 so that a forward end portion of the melting member 37 that comes into contact with the press receiving part 40 is melted, the melt resin that is the melting member 37 melted is poured into the gap 36 between both of the sandwiching parts 38*a*, and peripheries of the cables 2*a* to 2*c* are covered with the melt resin, the second step that the air escape opening part 41 is closed, and the third step that the melting member 37 is further pressed so as to be melted, so that the cables 2*a* to 2*c* are pressed by the melting resin poured into the gap 36 between both of the sandwiching parts 38*a*.

The melt resin 43 obtained by that the melting member 37 is melted is poured into the gap 36 between the cables 2*a* to 2*c* and the air-tight block 35, peripheries of the cables 2*a* to 2*c* can be covered with the melt resin 43 with no space and simultaneously the air-tight block 35 that is installed to be air-tight to the second housing 10 and the melting member 37 can be integrated with no space, and an air-tightness between the second housing 10 and the cables 2*a* to 2*c* can be sufficiently maintained. In addition, the embodiment is configured to have a composition that the cables 2*a* to 2*c* are pressed by the melt resin 43 poured into the gap 36 between both of the sandwiching parts 38*a*, so that the air-tightness can be further enhanced.

In addition, in the wire harness 1, the air escape opening part 41 is formed in the cable insertion hole 34 between both of the sandwiching parts 38*a*, and the melt resin 43 is poured into the gap 36 between both of the sandwiching parts 38*a* while an air is allowed to escape from the air escape opening part 41, so that generation of a problem can be prevented, that, for example, when the melt resin 43 is poured into the gap 36, an air is stored in the gap 36 between both of the sandwiching parts 38*a*, and a part of the cables 2*a* to 2*c* is not covered with the melt resin 43.

In addition, in the wire harness 1, the melting member 37 is formed to be inserted into a communication part in which the cable insertion holes 34 adjacent to each other are communicated with each other by the first insertion part 39 so as not to press the cables 2*a* to 2*c*, so that the air-tightness between the air-tight block 35 and the cables 2*a* to 2*c* can be maintained without allowing the sheath 5 of the cables 2*a* to 2*c* to be melted.

In addition, in the wire harness 1, since the cable insertion holes 34 are formed to be communicated with each other so that the cable insertion holes 34 adjacent to each other are stacked on each other (refer to FIGS. 5 and 15), a distance between cables 2*a* to 2*c* can be smaller, a pitch of the cables 2*a* to 2*c* can be further shortened and it can contribute to size reduction of the wire harness 1.

In addition, in the wire harness 1, the melting member 37 is configured to have a melting temperature lower than the air-tight block 35, so that a problem can be prevented, that the air-tight block 35 is melted when the melting member 37 is melted.

In addition, in the wire harness 1, the sandwiching parts 38*a* for sandwiching the cables 2*a* to 2*c* between the sandwiching parts 38*a* are formed as the closing part 38 in the air-tight block 35, so that the gap 36 formed on the peripheries of the cables 2*a* to 2*c* can be kept to have a predetermined distance, and the melt resin 43 can be surely supplied to the peripheries of the cables 2*a* to 2*c*. Namely, generation of a problem that, for example, a part of the cables 2*a* to 2*c* is not covered with the melt resin 43 can be prevented.

In addition, in the wire harness 1, the air-tight block 35 is formed to be divided into two pieces so as to be vertically sandwich the cables 2*a* to 2*c* arranged in parallel, so that the cables 2*a* to 2*c* can be easily inserted into the second housing 10 (the cable insertion hole 34).

Furthermore, in the wire harness 1, two melting members 37 are pressed simultaneously and the two melting members 37 are melt at almost the same speed, so that the melt resin 43 can be uniformly supplied to the gap 36.

Next, another embodiment according to the invention will be explained.

Figure 14:
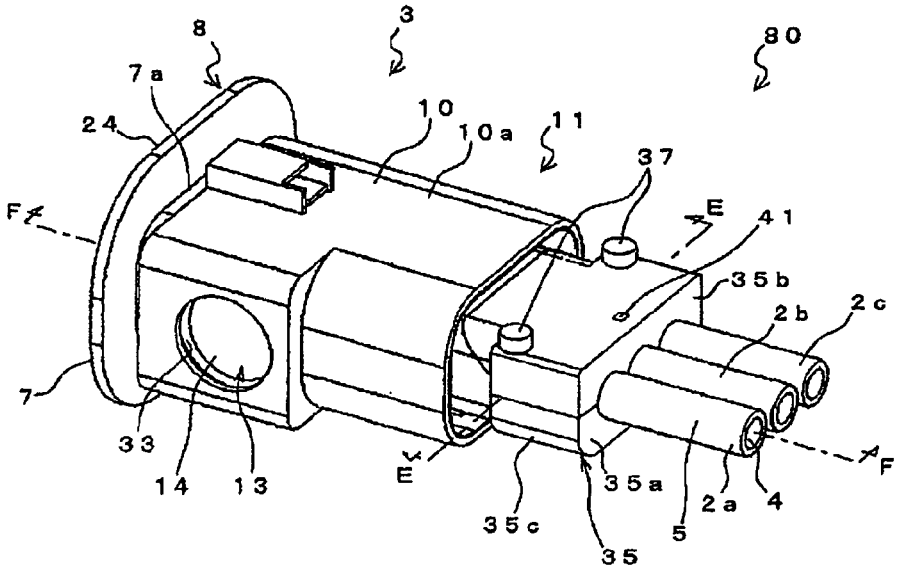
FIG. 14 is a perspective view schematically showing a wire harness according to another embodiment of the invention.
Figure 15:
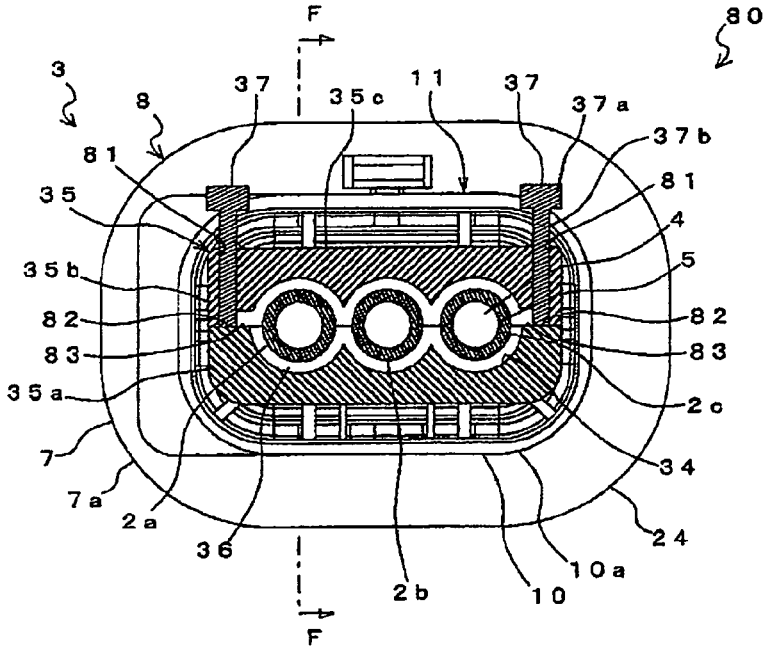
FIG. 15 is a cross-sectional view taken along the line E-E in FIG. 14.
Figure 16:
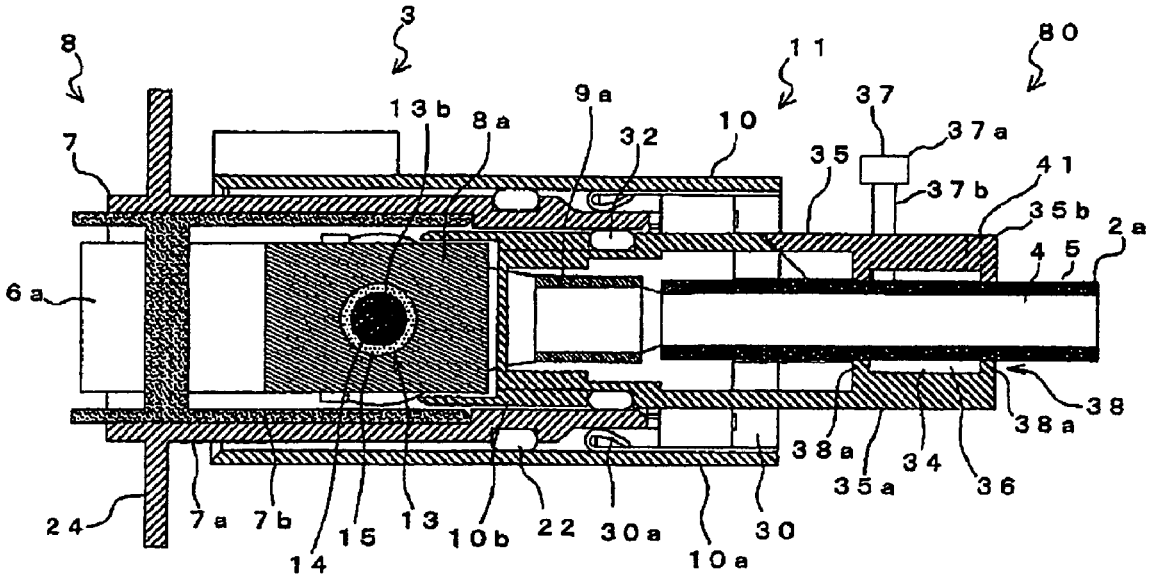
FIG. 16 is a cross-sectional view taken along the line F-F in FIG. 14.
Figure 17A:
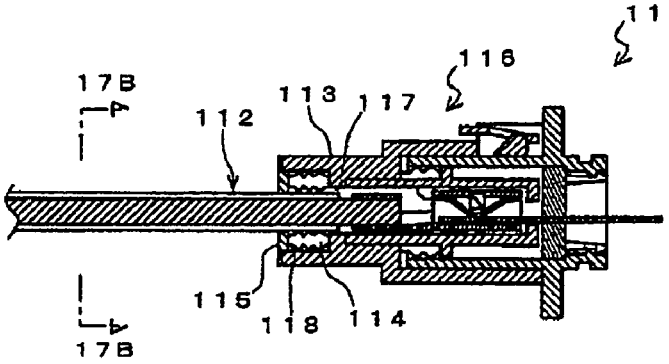
FIG. 17A is a longitudinal cross-sectional view schematically showing a conventional wire harness.
Figure 17B:
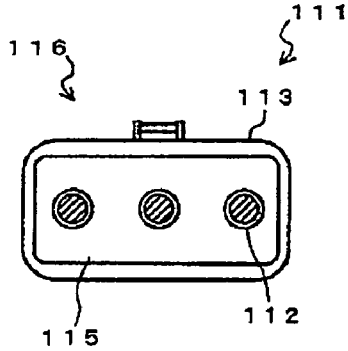
FIG. 17B is a cross-sectional view taken along the line 17B-17B in FIG. 17A.
Figure 18A:
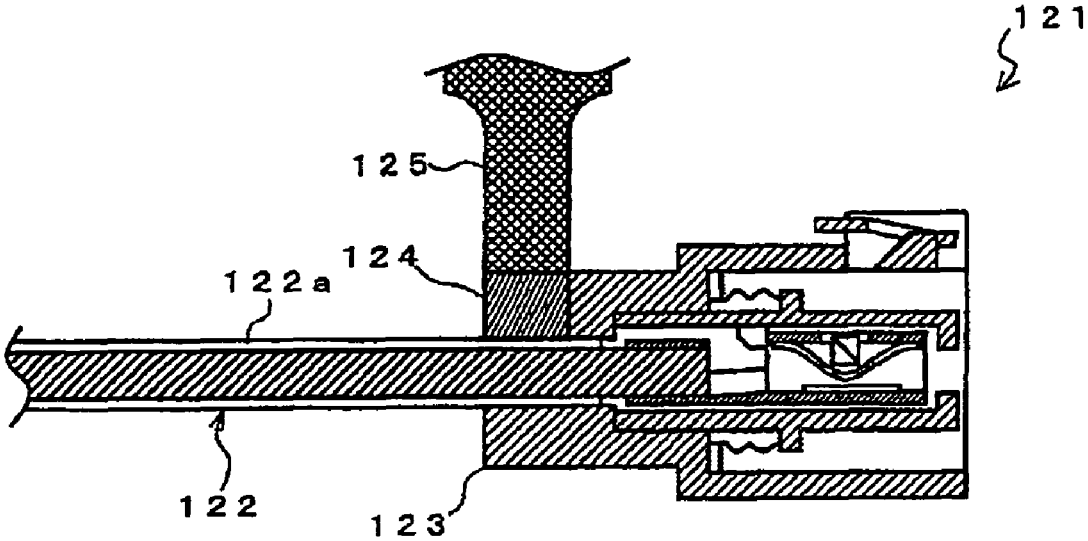
FIG. 18A is a longitudinal cross-sectional view schematically showing a conventional wire harness.
Figure 18B:
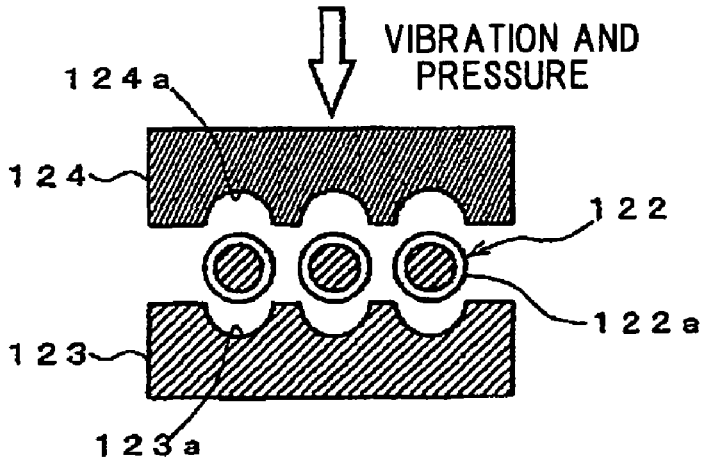
FIG. 18B is an exploded transverse cross-sectional view schematically showing an air-tightness maintaining structure in the conventional wire harness.

The wire harness 80 shown in FIGS. 14 to 16 has basically the same composition as the wire harness 1 explained in FIGS. 1 to 5, but is different from the wire harness 1 in an inserting position of the melting member 37.

Particularly, in the wire harness 80, the air-tight block 35 includes a second insertion part 81 that is a part into which the melting member 37 is inserted, and is communicated with the cable insertion holes 34 located at both ends of the plurality of cable insertion holes 34 arranged in parallel, and a second press receiving part 82 formed in an inner wall surface of the second insertion part 81 for allowing a forward end of the melting member 37 inserted into the second insertion part 81 to be pressed. Namely, the wire harness 80 is configured to have a composition that the second insertion part 81 and the second press receiving part 82 are formed instead of the first insertion part 39 and the first press receiving part 40 of the wire harness 1.

In the embodiment, in order to prevent the melting member 37 from being brought into contact with the cables 2*a* to 2*c*, the second insertion part 81 is formed to be located apart from the cables 2*a*, 2*c* arranged in both side along the parallel arrangement direction, at predetermined intervals. Further, a rear end portion 35*c* of the air-tight block 35 in which the second insertion part 81 is formed is formed to have a flange-like shape expanded in the parallel arrangement direction of the cables 2*a* to 2*c*.

The second insertion part 81 is communicated with the gap 36 formed around the cables 2*a* to 2*c* via a melt resin introduction hole 83 that is a part of the second insertion part 81. The melt resin introduction hole 83 is formed to have an approximately rectangular shape on a cross-section view, and an inner wall surface of the second insertion part 81, more particularly, an inner wall surface of the melt resin introduction hole 83 forms the second press receiving part 82 against which the melting member 37 is pressed.

In addition, in the wire harness 80, as the second insertion parts 81 are formed in both ends of the cables 2*a* to 2*c*, a position at which the air escape opening part 41 is formed is changed. The air escape opening part 41 is formed at a position where the melt resin 43 is filled finally, namely above or below the cable 2*b* arranged in the center, perpendicularly to a longitudinal direction of the cables 2*a* to 2*c*. In the wire harness 80, the air escape opening part 41 is formed above the cable 2*b* arranged in the center, namely in only a side where the second insertion part 81 is formed. The reason why this composition is adopted that the second insertion part 81 and the air escape opening part 41 are formed in the same side as the air-tight block 35 (FIG. 16 shows as an upper side), so that pressurization by the horn 42 and closing of the air escape opening part 41 by the closing member 44 can be carried out from the same direction, and the closing of the air escape opening part 41 by the closing member 44 can be carried out easily.

When the wire harness 80 is manufactured, similarly to a case of the wire harness 1, a composition can be adopted, that after the melt resin 43 is poured into the gap 36 between both of the sandwiching parts 38*a*, the air escape opening part 41 is closed, the melting member 37 is further pressed so as to be melted, and an inner pressure of the melt resin 43 is heightened so as to press the sheath 5 of the cables 2*a* to 2*c*.

In accordance with the wire harness 80, similarly to the wire harness 1, the melt resin 43 obtained by that the melting member 37 is melted can be poured into the gap 36 between the cables 2*a* to 2*c* and the cables 2*a* to 2*c* are pressed by the melt resin 43, so that the air-tight block 35 and the air-tightness between the air-tight block 35 and the cables 2*a* to 2*c* can be maintained without allowing the sheath 5 of the cables 2*a* to 2*c* to be melted.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

For example, a case that only the first insertion part 39 and the first press receiving part 40 are formed in the wire harness 1, and a case that only the second insertion part 81 and the second press receiving part 82 are formed in the wire harness 80 have been explained, but naturally, both of the first insertion part 39 and the first press receiving part 40, and the second insertion part 81 and the second press receiving part 82 can be formed.

In addition, in the above-mentioned embodiment, the air-tight block 35 is formed to be a part of the second inner housing 10*b*, but not limited to this, the air-tight block 35 can be also formed to be a part of the second outer housing 10*a*, and further, a composition that the air-tight block 35 is formed separately from the second housing 10 and the air-tight block 35 formed separately is formed to be air-tight to the second housing 10 can also be adopted.

Also, in the above-mentioned embodiment, when the vibration and pressurization to the melting member 37 are started and then the first setting time elapses, the first step moves into the second step and the air escape opening part 41 is closed, but not limited to this, for example, a composition can be also adopted, that the melt resin 43 that overflows the air escape opening part 41 is detected visually, and when the melt resin 43 overflows the air escape opening part 41, the air escape opening part 41 is closed. Further, in this case, in order to easily carry out visual confirmation that the melt resin 43 overflows the air escape opening part 41, it is preferred to use the melting member 37 having a color deferent from a color of the air-tight block 35.

In addition, in the above-mentioned embodiment, when the air escape opening part 41 is closed and then the second setting time elapses, the above-mentioned embodiment, when the vibration and pressurization to the melting member 37 are stopped, but not limited to this, for example, a composition can be also adopted, that a pressure sensor is installed in the horn 42 for detecting a pressure that presses the melting member 37, and when an output value of the pressure sensor becomes higher than a predetermined threshold value, the vibration and pressurization to the melting member 37 are stopped.

In addition, the above-mentioned embodiment is configured to have a composition that when the second division air-tight block 35*b* is welded to the first division air-tight block 35*a* due to the ultrasonic welding, the pressing by the horn is stopped at the time when the air-tight block 35 is adhered to the sheath 5 of the cables 2*a* to 2*c* at the sandwiching parts 38*a* to such an extent that the melt resin 43 is prevented from being leaked, but not limited to this, a composition can be also adopted, that in order to perfectly prevent the sheath 5 from being melted, a protection member that is formed of a metal or a resin having a melting temperature higher than the air-tight block 35 is formed in a periphery of the sheath 5 located at a position to be held by the sandwiching parts 38*a*, so that the air-tight block 35 and the sheath 5 are prevented from being directly brought into contact with each other.

Also, in the above-mentioned embodiment, two sandwiching parts 38*a* are formed as the blocking part 38, and the melt resin 43 is poured into the gap 36 between both of the sandwiching parts 38*a*, but not limited to this, for example, a composition can be also adopted, that the blocking part 38 is formed to include one sandwiching part 38*a* and a cable insertion hole closing member for closing a rear end portion of the cable insertion hole 34. In this case, in a state that the rear end portion of the cable insertion hole 34 is closed by the cable insertion hole closing member, the melt resin 43 can be poured into the gap 36 between the sandwiching part 38*a* and the cable insertion hole closing member. The cable insertion hole closing member can be removed or can be left as it stands after the melt resin 43 is solidified.

In addition, the above-mentioned embodiment is configured to have a composition that the melting member 37 has a melting temperature lower than the air-tight block 35, but not limited to this, a composition can be also adopted, that the melting member 37 and the air-tight block 35 are formed of the same material with each other or formed of materials of which melting temperatures are close to each other, and a metal member or a poorly-fusible resin member formed of a resin having a melting temperature higher than the melting member 37 is installed in the press receiving parts (the first press receiving part 40 and/or second press receiving part 82) to which the melting member 37 is pressed, so that the air-tight block 35 is prevented from being melted. In particular, the melting member 37 and the air-tight block 35 are formed of the same material with each other, so that when the melt resin 43 is solidified, the melting member 37 and the air-tight block 35 can be further firmly integrated with each other, and the air-tightness can be further enhanced.

In the above-mentioned embodiment, a case that the gap 36 between both of the sandwiching parts 38*a* is perfectly filled with the melt resin 43 has been explained, but the invention is not limited to this, a case that the gap 36 is not perfectly filled with the melt resin 43 and there is somewhat space can be also included in the scope of the technical idea of the invention.

In addition, in the above-mentioned embodiment, an air-tightness maintaining structure between the second housing 10 in the second connector part 11 and the cables 2*a* to 2*c* has been explained, but the invention is not limited to this, in case that the cables 2*a* to 2*c* are connected to the first connector part 8, the invention can be also applied to an air-tightness maintaining structure between the first housing 7 in the first connector part 8 and the cables 2*a* to 2*c*.

In addition, in the above-mentioned embodiment, the central conductor 4 in the cables 2*a* to 2*c* is formed to have an approximately circular shape on a cross-section view, but not limited to this, the invention can be also applied to the central conductor 4 in the cables 2*a* to 2*c* formed to have another shape, such as a rectangular shape.

What is claimed is:

1. A wire harness, comprising:

a plurality of cables arranged in parallel; and a connector comprising a housing to which end portions of the plurality of cables are connected, wherein the housing comprises an air-tight block at a side thereof that the plurality of cables are connected, the air-tight block comprising a plurality of cable insertion holes formed in parallel through which the plurality of cables are inserted into the housing, wherein the cable insertion holes are formed to have a gap with a predetermined distance between the cables and the air-tight block, two adjacent ones of the cable insertion holes being formed to overlap with each other and to communicate with each other, wherein the air-tight block further comprises two closing parts for closing a space between the air-tight block and the cables at two places along a longitudinal direction of the cables, and for defining a part of the cable insertion hole, an insertion part into which a melting member formed of a resin is inserted without pressing the cables, and which communicates with the cable insertion hole between the closing parts, a press receiving part formed in an inner wall surface of the insertion part or the cable insertion hole, for allowing a forward end of the melting member inserted to be pressed, and an air escape opening part that opens from the cable insertion hole between the closing parts toward an outside of the air-tight block, and wherein air-tightness between the air-tight block and the cables is maintained by:

a first step that the melting member is inserted into the insertion part, and the melting member is vibrated and pressed to the press receiving part so that a forward end portion of the melting member in contact with the press receiving part is melted into a melt resin, the melt resin is poured into the gap between the closing parts, and a periphery of the cables is covered with the melt resin;

a second step that the air escape opening part is closed; and a third step that the melting member is pressed so as to be melted, so that the cables are pressed by the melt resin poured into the gap between the closing parts.

2. The wire harness according to claim 1, wherein the insertion part is formed in the air-tight block between the closing parts and on an end portion side of the cables.

3. The wire harness according to claim 1, wherein the insertion part comprises a first insertion part formed to allow the melting member to be inserted into a part that the adjacent cable insertion holes communicate with each other.

4. The wire harness according to claim 1, wherein the insertion part comprises a second insertion part into which the melting member is inserted, and which communicates with two at both ends of the plurality of cable insertion holes arranged in parallel.

5. The wire harness according to claim 1, wherein the air-tight block is formed of a resin, and the melting member has a melting temperature lower than the air-tight block.

6. The wire harness according to claim 1, wherein the air-tight block is formed of a resin, the melting member and the air-tight block are formed of a material equal to each other or materials of which melting temperatures are close to each other, and a metal member or a high melting point member formed of a resin of which a melting temperature is higher than the melting member is installed in the press receiving parts against which the melting member is pressed.

7. The wire harness according to claim 1, wherein the closing part comprises a sandwiching part for sandwiching the cables so as to keep the gap formed on the periphery of the cables to have a predetermined distance.

8. The wire harness according to claim 1, wherein the air-tight block is formed of a pair of division air-tight blocks that is formed of a resin, and is divided into two pieces so as to vertically sandwich the plurality of cables arranged in parallel, and on the condition that the plurality of cables are sandwiched between the pair of division air-tight blocks, the pair of division air-tight blocks is welded by ultrasonic welding so as to be integrated.

9. The wire harness according to claim 1, wherein the plurality of insertion parts and the plurality of press receiving parts are formed and the melting member is inserted into the plurality of insertion parts, respectively, and the plurality of melting members inserted into the plurality of insertion parts are pressed simultaneously.

10. A method of manufacturing a wire harness comprising a plurality of cables arranged in parallel, and a connector comprising a housing to which end portions of the plurality of cables are connected, wherein the housing comprises an air-tight block at a side thereof that the plurality of cables are connected, the air-tight block comprising a plurality of cable insertion holes formed in parallel through which the plurality of cables are inserted into the housing, wherein the cable insertion holes are formed to have a gap with a predetermined distance between the cables and the air-tight block, two adjacent ones of the cable insertion holes being formed to overlap with each other and to communicate with each other, and wherein the air-tight block further comprises two closing parts for closing a space between the air-tight block and the cables at two places along a longitudinal direction of the cables, and for defining a part of the cable insertion hole, an insertion part into which a melting member formed of a resin is inserted without pressing the cables, and which communicates with the cable insertion hole between the closing parts, a press receiving part formed in an inner wall surface of the insertion part or the cable insertion hole, for allowing a forward end of the melting member inserted to be pressed, and an air escape opening part that opens from the cable insertion hole between the closing parts toward an outside of the air-tight block, the method comprising:

a first step that the melting member is inserted into the insertion part, and the melting member is vibrated and pressed to the press receiving part so that a forward end portion of the melting member in contact with the press receiving part is melted into a melt resin, the melt resin is poured into the gap between the closing parts, and a periphery of the cables is covered with the melt resin;

a second step that the air escape opening part is closed; and a third step that the melting member is pressed so as to be melted, so that the cables are pressed by the melt resin poured into the gap between the closing parts, in order to maintain air-tightness between the air-tight block and the cables.

* * * * *